US005389151A

United States Patent [19]

Fort

[11] Patent Number: 5,389,151

[45] Date of Patent: Feb. 14, 1995

[54] INTERCHANGEABLE CONTACT/NON-CONTACT DISPENSING SYSTEM

[75] Inventor: Wesley Fort, Norcross, Ga.

[73] Assignee: Nordson Corporation, Westlake, Ohio

[21] Appl. No.: 31,738

[22] Filed: Mar. 15, 1993

[51] Int. Cl.[6] ..... B05C 1/00; B05C 5/00; B05B 1/00

[52] U.S. Cl. ..... 118/411; 118/413; 239/598; 239/600

[58] Field of Search ..... 118/411, 413; 239/597, 239/598, 600; 425/261

[56] References Cited

U.S. PATENT DOCUMENTS 4,440,105 4/1984 Jeltema ..... 118/413
4,774,109 9/1988 Hadzimihalis et al. ..... 118/411
5,067,432 11/1991 Lippert ..... 118/413

*Primary Examiner*—Sun Uk Kim
*Attorney, Agent, or Firm*—Wood, Herron & Evans

[57] ABSTRACT

An interchangeable adhesive dispensing system adaptable for use in contact or non-contact adhesive dispensing includes a gun body, an adapter and a clamp which threadably connects to the gun body by bolts to compressively hold therebetween either a nozzle plate used for non-contact dispensing or a doctor blade assembly used for contact dispensing. To changeover from one type of dispensing to the other, the clamp is loosened so that the nozzle plate or doctor blade assembly may be removed from between the adapter and the clamp, a new nozzle plate or doctor blade assembly is located between the adapter and the clamp, and the clamp is tightened to the gun body.

4 Claims, 2 Drawing Sheets

INTERCHANGEABLE CONTACT/NON-CONTACT DISPENSING SYSTEM

FIELD OF THE INVENTION

This invention relates to an adhesive dispensing system, and more particularly to an adhesive dispensing system used in the sealing of cartons.

BACKGROUND OF THE INVENTION

In the carton filling and sealing industry, particularly paperboard cartons used to package food, soap, etc., each carton travels along a conveyer path that is typically laid out in an elongated oval-shape with two parallel sides. At a carton feed station, located at one end of the oval, a carton feeding device connects each carton to a carrier unit secured to the conveyer line, with the elongated dimension of the carton oriented parallel with the travel path of the conveyer. As the conveyer advances the carton along one of the sides, flap guides hold open the major flaps at the bottom end of the carton, and an adhesive gun dispenses two patterns of adhesive on the spaced edges of the major flaps. These patterns are oriented perpendicular to the travel path of the conveyer. A caulk gun then dispenses a pattern of caulk on one of the major flaps, the caulk pattern being parallel to the travel path of the conveyer. Folding rails then fold the major flaps to seal the bottom of the carton. At the end of the first side, a filler fills the carton via the open upper end. Thereafter, the conveyer conveys the carton along the other side of the oval-shaped layout, and similar mechanisms operate to dispense adhesive and seal the upper end of the carton. A conveyer line of this type occupies about forty feet by twenty feet of floor space.

Generally, two types of adhesive dispensing systems have been used in carton filling and sealing operations of this type. These two types of systems are referred to as "contact" and "non-contact", depending upon whether or not a nozzle orifice of the system actually contacts the flaps of a carton when the adhesive is applied thereto.

For many years, contact adhesive dispensing systems have been the most popular in the carton filling and sealing industry. In contact adhesive dispensing, the system includes a doctor blade assembly which remains in contact with the carton flap, and therefore it is easy to coat a relatively large area with a large continuous bead of adhesive. Typically, the doctor blade assembly includes a backplate, a shim and a front plate which bolt directly to a gun body and adapter assembly. The gun body includes at least one internal conduit and a control mechanism for supplying pressure for controlling the flow of adhesive through the conduits, through aligned passages and an outlet channel in the adapter and finally, into and through passagways in the doctor blade assembly. The passageways open to a spacing between the front and the back plates where the shim has at least one cut-out region. The width of this spacing is determined by the thickness of the shim.

Particularly for cartons which, because of their contents, must have an infestation-proof seal, i.e., a continuous, relatively thick stripe of adhesive sufficient to prevent ingress of insects, contact dispensing guns remain popular because they provide the greatest certainty in achieving a consistent and reliable infestation-proof seal. Moreover, because of the structural components used to apply the adhesive, i.e., the doctor blade assembly, contact adhesive dispensing systems are not susceptible to clogs and therefore may be used with adhesives having a wide range in viscosity.

One primary disadvantage of contact adhesive dispensing systems relates to carton jams along the conveyor line. Because contact dispensing inherently requires direct contact between the doctor blade assembly and the flaps of the box, the relative positions of the entry and exit flap guides and the doctor blade assembly must be maintained securely in proper position throughout the operation. If one carton flap jams against the doctor blade assembly, the entire conveyor line must be shut down, the partially sealed cartons must be removed from the line and discarded, and the entire conveyor line must be restarted. In short, due to its inherent susceptibility to jamming, contact adhesive dispensing systems result in excessive conveyor downtime and a large number scrap cartons which cannot be reused.

In non-contact adhesive dispensing, a plurality of small nozzle tips spray the adhesive in a plurality of parallel streams onto the flaps of the carton from a distance of about a quarter inch to an inch. Usually, the nozzle tips are arranged in a row, and the rows are oriented perpendicular to the travel path of the conveyor. This produces an elongated stripe pattern comprising a plurality of parallel adhesive lines oriented perpendicular to the elongated dimension of the pattern. The nozzle tips are housed within the outlets of passageways in a nozzle plate. The nozzle plates secures to the adapter with inlet ends of the passageways in alignment with the outlet channel of the adapter.

Because of the spacing between the nozzles and the flaps, carton jams seldom occur. For these and other reasons, the carton filling and sealing industry has gradually moved toward more use of non-contact dispensing for forming siftproof seals, i.e., seals which must prevent egress of contents, such as macaroni, etc. Nevertheless, there remains a need for contact-type dispensing guns, particularly when an infestation-proof seal is required or for use with adhesives of relatively high viscosity.

Additionally, for various economic reasons, including changing marketing concepts and present tax treatment of stock, or inventory, it is no longer advantageous for carton filling and sealing companies to maintain multiple dedicated conveyor lines, with each line dedicated to one particular product and/or carton size and shape. As a result, conveyor lines must be adapted to accommodate different sizes and shapes of cartons and different types of adhesive dispensing and sealing operations.

It is an objective of this invention to reduce the downtime associated with changing a carton filling and sealing conveyor line from one type of adhesive dispensing to another type of adhesive dispensing.

It is another objective of this invention to expand the capability of a dispensing system used in a carton filling and sealing operations to a wider variety of carton sizes and shapes and/or a wider variety of dispensing operations.

The above-stated objectives are achieved by an adhesive dispensing system adapted to be easily converted between contact adhesive dispensing and non-contact adhesive dispensing, and vise versa, via a clamp which releasably secures to a gun body to compressively hold either a doctor blade assembly or a nozzle plate in contact with an adapter mounted to the bottom of the gun body. The profile of the doctor blade assembly and the nozzle plate are identical in size and shape to fit securely between the adapter and the clamp when the clamp is bolted to the gun body.

By loosening the clamping plate from the gun body, the doctor blade assembly or the nozzle plate may be removed from between the clamp and the adapter, and another doctor blade assembly or nozzle plate may be located therebetween and secured therein by again tightening the clamp against the gun body.

By providing identical profiles for a nozzle plate and a spreader blade assembly, and a clamp for securing either one of these identically shaped profiles to the gun adapter, the dispensing gun may be quickly and easily converted between contact-type adhesive dispensing and non-contact type dispensing, and vise versa.

Because of the structural arrangement of the clamp with respect to the gun body, the gun adapter and the nozzle plate or the doctor blade assembly, this invention reduces the downtime associated with converting a conveyor line from one type of dispensing operation to another. Thus, in addition to enabling relatively easy conversion between contact and non-contact dispensing, this invention also facilitates changeover from one type of non-contact dispensing to another type of non-contact dispensing, or from one type of contact dispensing to another type of contact dispensing, as required when a different size or shape carton must be filled and sealed.

According to a preferred embodiment of the invention, this interchangeable contact/non-contact dispensing system includes a modular body, an adapter, two or more plug-in dispensing modules, a clamp and at least one interchangeable nozzle plate or doctor blade assembly. The modular body includes at least one internal conduit fed by an inlet connected to an adhesive supply line. These conduits communicate with inlets in the plug-in modules, and outlets of the plug-in modules communicate with passages in the adapter. The adapter passages communicate with an exit channel oriented transverse to the ends of the passages. The clamp clamps to a front face of the modular body, as by bolts, to compressively hold either the nozzle plate or the doctor blade assembly between the adapter and a bottom portion of the clamp. This securement arrangement locates inlet ends of passageways formed in the doctor blade assembly or the nozzle plate in alignment with the channel, thereby to allow adhesive flow therebetween. Pressurized adhesive conveyed through the modular body, the plug-in modules, the adapter and eventually into the channel is subsequently dispensed outwardly from these passageways formed in the nozzle plate or the doctor blade assembly.

For contact dispensing, the doctor blade assembly is used. The doctor blade assembly includes a backplate with passageways aligned in fluid communication with the channel, a shim and a front plate. The front and back plate sandwich the shim, and dispensing adhesive exits from between the front and back plates via one or more vertical slots or cut-outs formed in the shim.

For non-contact dispensing, a nozzle plate is used. The nozzle plate includes a plurality of parallel passages, each of which terminates at a nozzle tip which is spaced about one inch or less from the substrate.

For non-contact or contact dispensing, the clamp securely holds the nozzle plate or the doctor blade assembly, respectively, against the adapter, with the passageways in alignment with the channel so that dispensing may take place. The cross sectional profiles of the nozzle plate and the doctor blade assembly are identical so that the clamp provides sufficient compressive holding force during either non-contact or contact dispensing. Preferably, the clamp includes a rounded bottom. When the clamp is tightened to the gun body, this rounded bottom urges the nozzle plate or the doctor blade assembly in an upward direction rather and into alignment with the channel, rather than in a downward direction and out of alignment with the channel.

In operation, the clamp is loosened to allow the nozzle plate or doctor blade assembly to be removed from between the adapter and the clamp. A different nozzle plate or doctor blade assembly is then placed against the adapter, with the passageways of the new nozzle plate or doctor blade assembly located in alignment with the channel. The clamp is then tightened to secure the new nozzle plate or doctor blade assembly in place. Preferably, loosening and tightening of the clamp occurs via loosening and tightening of threaded bolts which are threadably received in the gun body.

Because of the relative ease in loosening the clamp, removing the nozzle plate or doctor blade assembly, substituting a new nozzle plate or doctor blade assembly and then retightening the clamp, this dispensing system simplifies the changeover process required to convert a carton filling and sealing line from one type of dispensing operation to another type of dispensing operation. This dispensing system also reduces the time required for this changeover process. Because of the simplification and the reduced time required for changeover, this dispensing system also reduces the costs associated with filling and sealing cartons.

According to another aspect of the invention, a non-contact dispenser may be operated at a higher pressure to produce a continuous stripe pattern of adhesive on a carton flap, rather than a plurality of thin parallel lines arranged in perpendicular to an elongated stipe pattern. This resulting continuous adhesive pattern resembles the pattern which could only previously be produced by using a contact dispensing system.

These and other features of the invention will be more readily understood in view of the drawings and the following detailed description.

DETAILED DESCRIPTION OF THE DRAWINGS

Figure 1:
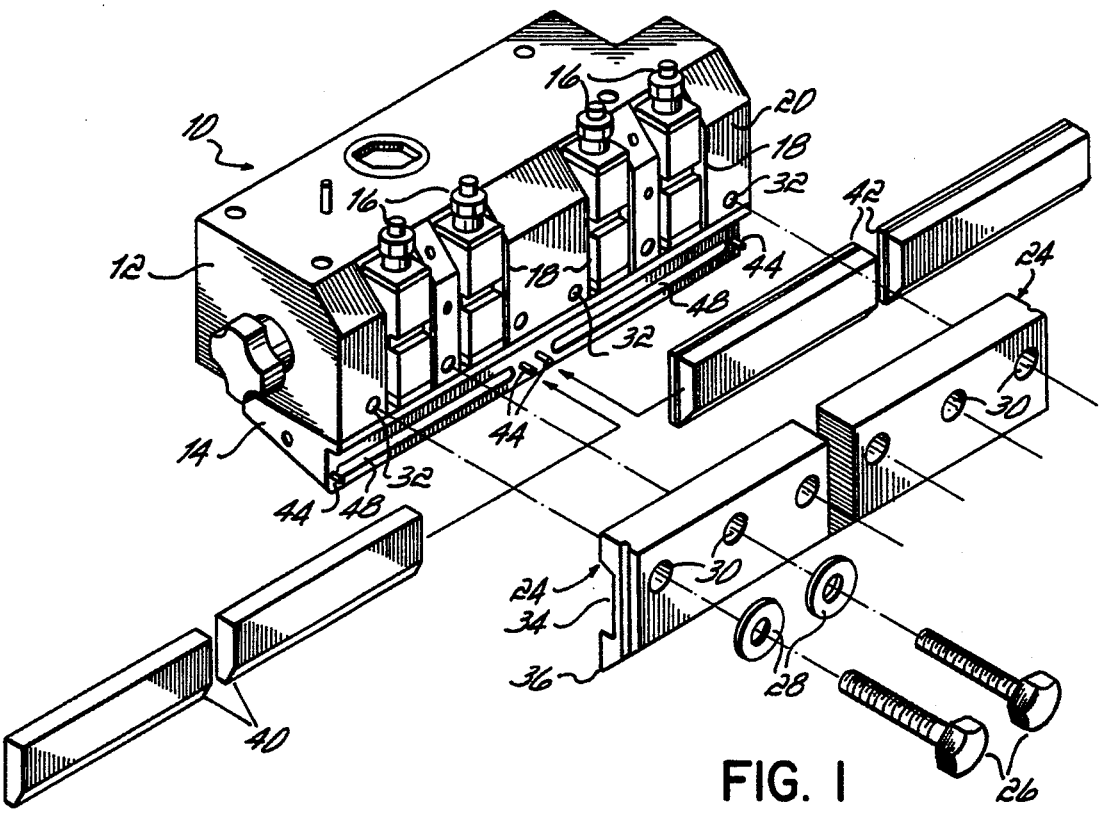
FIG. 1 is a disassembled perspective of an interchangeable contact/non-contact dispensing system constructed in accordance with a preferred embodiment of the invention.

FIG. 1 shows an interchangeable contact/non-contact dispensing system 10 constructed in accordance with a preferred embodiment of the invention. This dispensing system 10 includes a modular or gun body 12 which is typically oriented transverse to the travel path of a conveyer carrying a carton to be sealed in a filling and sealing operation. An adapter 14 connects to the bottom of the body 12, preferably by bolts (not shown). The modular body 12 may be of the type disclosed in U.S. Pat. No. 5,027,976, issued to Scholl et al, and owned by the assignee of this invention, the disclosure of which is incorporated by reference herein in its entirety. Generally, the modular body 12 is connected by a line (not shown) to a source of heated, hot-melt thermoplastic adhesive (not shown), and the body 12 includes a plurality of internal conduits which convey the adhesive to a plurality of passages formed in the adapter 14.

In the embodiment of the invention depicted in FIG. 1, the dispensing adhesive conveyed from body 12 to adapter 14 flows through plug-in modules 16 which reside within recesses 18 cut into a front face 20 of the modular body 12. The plug-in modules 16 provide precision control of dispensing parameters such as flow rate and pressure. The details of this plug-in module 16 are disclosed in assignee's co-pending U.S. patent application Ser. No. 07/956,795 filed on Oct. 5, 1992, now U.S. Pat. No. 5,277,344, in the name of Thomas C. Jenkins, which is expressly incorporated by reference herein in its entirety. The details of the modular body 12, the plug-in modules 16 and the internal passages therethrough form no part of the present invention.

A clamp 24 mounts to the front face 20 of the modular body 12, preferably by bolts 26 which extend through washers 28, through apertures 30 formed in clamp 24 and which threadably engage threaded bores 32 formed in the front face 20. The clamp 24 includes an internal cut out region 34 and a rounded bottom 36.

FIG. 1 also shows a pair of nozzle plates 40 which may be compressively held between the adapter 14 and the clamp 24 when the bolts 26 are tightened. The nozzle plates 40 are used during non-contact adhesive dispensing. For contact adhesive dispensing, doctor blade or spreader assemblies 42 are used. To changeover from non-contact to contact dispensing, the bolts 26 are loosened to enable removal of the nozzle plates 40 from between the clamps 24 and the adapter 14, the spreader assemblies 42 are positioned between the adapter 14 and the clamp 24, and the bolts 26 are again tightened. When in position, each nozzle plate 40 and spreader assembly 42 is impaled upon horizontal alignment pins 44 which extend forwardly from the adapter 14. Thus the clamp 24 is removably securable to the gun body 12 so that a clamping portion thereof resides a predetermined distance from the adapter 14. This predetermined distance is sufficiently great to accommodate noncontact dispensing via a nozzle plate 40, or contact dispensing via a spreader assembly 42.

FIG. 1 shows two nozzle plates 40 and two doctor blades, or spreader assemblies 42, one for each pair of plug-in modules 16. This arrangement corresponds to a single manifold dispensing system for dispensing adhesive upon both major flaps of a carton, wherein the width of the carton corresponds to the space between the two closest plug-in modules 16. Alternatively, for varying carton sizes, the dispensing system 10 may include multiple manifolds, thereby requiring two separate, spaced sets of modular bodies 12, adapters 14 and clamps 24. The size and shape of the carton will dictate the particular type of dispensing system 10.

Figure 2:
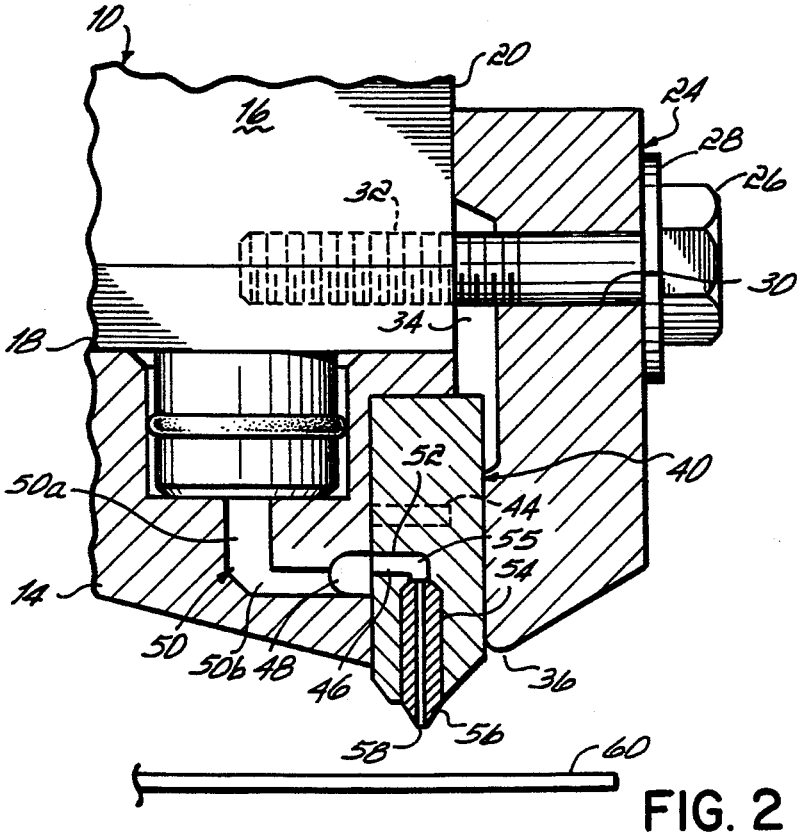
FIG. 2 is a cross sectional view of the dispensing system shown in FIG. 1, with the dispensing system equipped with a nozzle plate for non-contact dispensing.
Figure 3:
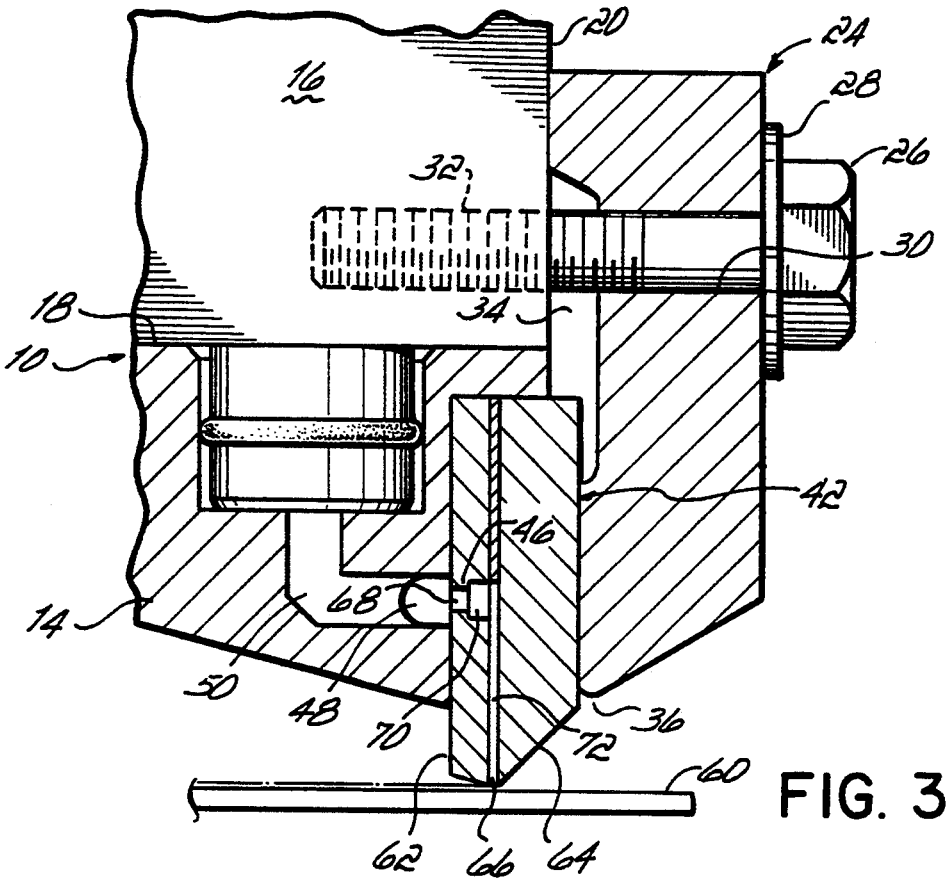
FIG. 3 is a cross sectional view of the dispensing system shown in FIG. 1, with the dispensing system equipped with a doctor blade assembly for contact dispensing.

As shown in FIGS. 2 and 3, when impaled upon the alignment pins 44, a plurality of passageways 46 formed in the nozzle plate 40 or the spreader assembly 42 are aligned with and in fluid communication with a transverse depression or exit channel 48 which extends along the front of the adapter 14 (FIG. 1). The dispensing adhesive is supplied to the channel 48 via a plurality of passages 50 formed in the adapter 14. There is preferably at least one passage 50 for each plug-in module 16. Preferably, each passage 50 includes a vertically oriented section **50*a* with a length of about 0.170 inches and a volume of about 0.0011 inches$^3$, and a horizontally oriented section 50*b*** with a length of about 0.274 inches and a volume of about 0.0019 inches$^3$.

FIG. 2 shows the details of the nozzle plate 40. More specifically, each passageway 46 includes a horizontally oriented inlet portion 52 and a vertically oriented outlet portion 54. A nozzle tip 56 resides within outlet portion 54, and the nozzle tip 56 includes an outlet orifice 58 through which adhesive is dispensed in a non-contact manner toward substrate 60. The orifice 58 diameter may vary from 0.008 to 0.021 inches. Preferably, the length of inlet portions 52 is about 0.105 inches, and the volume is about 0.001 inches$^3$. The length of outlet portions 54 is about 0.349 inches, and the volume is about 0.0015 inches$^3$. A central portion 55, located between inlet portion 52 and outlet portion 54, has a volume of about 0.0001 inches$^3$. The total length of the fluid path from the plug-in module 16 to the orifice 58 is about 0.916 inches and the total fluid volume in this path is about 0.0048 inches$^3$.

Preferably, during operation, the outlet orifice 58 is located about 0.25–1.0 inches from the substrate 60. Typically, due to pressure supplied to the adhesive via the plug-in modules 16, the nozzle plate 40 generates a plurality of fine spaced streams of adhesive, and the parallel streams produce a plurality of short, parallel adhesive lines arranged in a stripe pattern, with the lines oriented perpendicular to the elongated dimension of the stripe.

FIG. 3 shows the details of the spreader assembly 42 used during contact adhesive dispensing. More particularly, the spreader assembly 42 includes a backplate 62, a front plate 64, and a shim 66 held therebetween. Like nozzle plate 40, the spreader assembly 42 includes a plurality of spaced passageways 46 which communicate with the channel 48. The passageways 46 in the spreader assembly 42 comprise reduced diameter inlet sections 68 and enlarged diameter outlet sections 70 formed in the backplate 62. Together, the inlet section 68 and the outlet section 70 have a length of about 0.063 inches and a volume of about 0.0002 inches$^3$.

Each inlet section 68 is aligned with and in fluid communication with the channel 48, and each outlet section 70 is aligned with a cut out region 72 formed in the shim 66. If desired, the shim 66 may include a plurality of cut outs, or notches, as disclosed in U.S. Pat. No. 4,774,109. The shim 66 has a thickness which may range from 0.004 to 0.016 inches. The total length of the fluid path from the plug-in module 16 to the shim 66 is about 0.733 inches, and the total fluid volume in this path is about 0.0032 inches$^3$. If desired, the backplate 62, the shims 66 and the front plate 64 may be separately bolted together.

In operation, pressurized adhesive conveyed via passage 50, channel 48, inlet sections 68 and outlet sections 70 flows downwardly through the notches 72 between backplate 62 and front plate 64, thereby exiting from the doctor blade assembly 42. The bottom edges of the backplate 62 and the front plate 64 reside in contact with the substrate 60.

As described previously, contact dispensing is generally required to form infestation proof seals on cartons and for dispensing adhesives of relatively high viscosity. On the other hand, non-contact adhesive dispensing is preferable in many other situations, due to its reduced susceptibility to carton jamming and the capability of providing a siftproof seal with a plurality of parallel streams.

By utilizing a clamp 24 for compressively holding either a nozzle plate 40 or a spreader assembly 42 to a dispensing adapter 14, this invention enables the benefits of both contact and non-contact adhesive dispensing to be achieved with one dispensing system 10. As a result of the relatively easy interchangeability between contact and non-contact dispensing, and vise versa, one conveyor line may be used for sealing a wide variety of different size and shape cartons, thereby eliminating the need for multiple conveyor lines dedicated for single use and the need for maintaining large inventories.

This invention also contemplates expanding the use of a non-contact dispensing gun to dispense a continuous stripe pattern on the substrate 60, rather than a plurality of parallel adhesive lines oriented perpendicular to the elongated dimension of the stripe pattern. This objective may be achieved by operating the system 10 shown in FIG. 2 at an elevated pressure. Typically the pressure will be 25–30% higher than the normal operating pressure associated with a contact system for standard packaging grade hot melt adhesives. The exact pressure will vary depending upon the viscosity of the adhesive. For example, the pressure may be within the range of 400–1200 psi, depending upon the adhesive, but will typically be within the range of 600–1000 psi for standard packaging grade adhesives. In any event, this elevated pressure should be of such a sufficient pressure to cause the dispensed adhesive to fan outwardly in flight and to coalesce on the substrate 60, thereby producing a thick continuous stripe rather than a plurality of parallel, thin adhesive lines arranged in a rectangular stripe pattern.

This method overcomes one primary disadvantage of non-contact dispensing, discontinuities across the elongated stripe pattern produced by clogs in one or more of the passageways. By operating at sufficiently high pressures that the adhesive streams come together to form a continuous stripe, the adverse effects of one clog will be reduced. As a result, a reliable siftproof seal can be formed even if some nozzle clogging occurs. It may even be possible to operate the system 10 in a non-contact mode to achieve an infestation proof seal.

While we have described only two embodiments of our invention, persons skilled in this art will appreciate changes and modifications which may be made without departing from the spirit of our invention. Therefore, we do not intend to be limited except by the scope of the following appended claims.

I claim:

1. An adhesive dispensing system comprising:

a gun body having at least one internal fluid conduit;

an adapter mounted below the body, the adapter including at least one internal fluid passage in fluid communication with the conduit, the at least one passage terminating in a channel;

a clamp removably securable to the gun body and having a clamping portion which resides a predetermined distance from the adapter when the clamp is secured to the gun body, said pre-determined distance being sufficiently great to accommodate non-contact dispensing means; and dispensing means having a thickness equal to said pre-determined distance so as to be compressively held in a dispensing position defined by the predetermined distance between the clamping portion and the adapter when the clamp is secured to the gun body, the dispensing means including a plurality of fluid passageways aligned with the channel when the dispensing means is located in the dispensing position, the dispensing means adapted to receive adhesive from the channel and to convey the adhesive outwardly from the system, via the passageways, and onto a surface, the dispensing means further including a nozzle plate for operation in a non-contact mode of dispensing said adhesive and a spreader assembly for operation in a contact mode of dispensing said adhesive, the nozzle plate and the spreader assembly being interchangeably positionable in the dispensing position by securing and unsecuring, respectively, the clamp to the gun body, the dispensing means thereby adapted to dispense in one of the following modes, contact and non-contact, and to facilitate changeover of the system to dispense in the other of the modes.

2. The dispensing system of claim 1 and further comprising:

means for threadably securing the clamp to the gun body.

3. The dispensing system of claim 1 wherein said clamping portion includes means for urging the dispensing means in an upward direction when the clamp is secured to the gun.

4. The dispensing system of claims 3 wherein the urging means comprises a rounded surface located at a bottom end of the clamping portion.

* * * * *